US011001470B2

(12) United States Patent
Enomoto

(10) Patent No.: US 11,001,470 B2
(45) Date of Patent: May 11, 2021

(54) SHEET PRESSING APPARATUS AND IMAGE FORMING SYSTEM HAVING THE SAME

(71) Applicant: Shinnosuke Enomoto, Yamanashi-ken (JP)

(72) Inventor: Shinnosuke Enomoto, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/709,079

(22) Filed: Dec. 10, 2019

(65) Prior Publication Data

US 2020/0180899 A1 Jun. 11, 2020

(30) Foreign Application Priority Data

Dec. 10, 2018 (JP) ..... JP2018-230532
Dec. 10, 2019 (JP) ..... JP2019-222744

(51) Int. Cl.
*B65H 45/18* (2006.01)
*B65H 45/04* (2006.01)
*B65H 45/30* (2006.01)

(52) U.S. Cl.
CPC ..... *B65H 45/18* (2013.01); *B65H 45/04* (2013.01); *B65H 45/30* (2013.01); *B65H 2301/4505* (2013.01); *B65H 2701/13212* (2013.01); *B65H 2801/27* (2013.01); *G03G 2215/00877* (2013.01)

(58) Field of Classification Search
CPC ..... B31F 1/0006; B31F 1/0035; G03G 2215/00877; B65H 45/04; B65H 45/18; B65H 45/30; B65H 2301/4505; B65H 2701/13212; B65H 2801/27
USPC ..... 270/32, 45, 58.07
See application file for complete search history.

(56) References Cited

U.S. PATENT DOCUMENTS 8,251,359 B2 * 8/2012 Suzuki ..... B65H 45/18 270/45
9,688,503 B2 * 6/2017 Fukasawa ..... B65H 45/18
(Continued)

FOREIGN PATENT DOCUMENTS

JP 2008-189404 A 8/2008
JP 2012-171727 A 9/2012

*Primary Examiner* — Leslie A Nicholson, III
(74) *Attorney, Agent, or Firm* — Manabu Kanesaka

(57) ABSTRACT

A sheet pressing apparatus includes an inlet port for receiving a sheet having a folding line; additional folding rollers supported by a supporting member arranged downstream from the inlet port; a lower folding guide opposing the additional folding rollers; a first drive mechanism configured to move the additional folding rollers between a pressing position, at which the additional folding rollers approach the lower folding guide to press the sheet at the folding line, and a retreat position to which the additional folding rollers are moved from the pressing position, separating from the sheet; and a second drive mechanism configured to move the additional folding rollers along the folding line. The additional folding rollers are arranged such that one end of the folding line exists between the two additional folding rollers provided at one position and the additional folding roller at the other end position is arranged on the folding line.

6 Claims, 8 Drawing Sheets

(56) References Cited

U.S. PATENT DOCUMENTS

| | | | | |
|---|---|---|---|---|
| 9,815,656 | B2 * | 11/2017 | Awano | B65H 45/12 |
| 10,377,604 | B2 * | 8/2019 | Awano | B29C 53/06 |

* cited by examiner

SHEET PRESSING APPARATUS AND IMAGE FORMING SYSTEM HAVING THE SAME

BACKGROUND OF THE INVENTION

Field of the Invention

The present invention relates to a sheet pressing apparatus designed to fold a sheet, and also to an image forming system of a copier, a printer, a facsimile apparatus and a composite machine of such apparatus or the like that comprises such a sheet pressing apparatus.

Background Art

There is conventionally known a sheet folding apparatus (post-processing apparatus) installed in an image forming system of a copier, a printer or the like and designed to execute a sheet folding process once by means of the sheet folding processing section thereof to produce one or more folds and subsequently and additionally press (execute an additional folding process on) the one or more folds by a separated pressing member for the purpose of preventing the thickness (height) of the folded part formed on the sheet by means of the sheet folding processing section from remarkably increasing.

For example, Patent Document 1 discloses a sheet folding apparatus designed to operate such that, in a process of folding each of the sheets (of paper) that are being continuously conveyed in, the preceding sheets that have been folded are temporarily stacked in another transport path and, after the end of the operation of folding the succeeding sheets, the stacked preceding sheets and the succeeding sheets are transported to an additional folding section, where a repress roller is driven to move on and along the folding line of the preceding sheets and the succeeding sheet laid on the preceding sheets in a direction intersecting the direction of transporting the sheets in order to repress both the folded parts (folding line) of the preceding sheets and those of the succeeding sheets.

Further, Patent Document 2 discloses a booklet additional-folding mechanism having a plurality of rollers, a roller supporting member, and a mounting table. The rollers are supported by the roller supporting member which extends along the sides of the folds of the booklet being transported. While the booklet is being pressed between the mounting table and the rollers, the roller supporting member is moved along the folding line, thereby performing the additional folding process. In the booklet additional-folding mechanism disclosed in Patent Document 2, the roller supporting member is L-shaped, composed of a horizontal plate which extends parallel to the mounting table and a vertical plate which intersects with the horizontal plate at right angles and extends along the folding line of the booklet. A shaft guide is secured to a movable pushing means for moving the roller toward the folding line of the booklet to have the rollers press a portion on or around the folding line, and a shaft is secured, inclining to the folding line of the sheet placed on mounting table. As the movable pushing means moves to push the rollers, the shaft is moved with respect to the shaft guide. The roller supporting member is thereby moved along the folding line of the booklet.

PRIOR ART DOCUMENT

Patent Document

[Patent Document 1] Japanese Patent Application Publication No. 2012-171727

[Patent Document 2] Japanese Patent Application Publication No. 2008-189404

In the sheet folding apparatus disclosed in Patent Document 1, one repress roller is moved along the folding line of the sheet, from one edge of the folding line to the other edge thereof, thereby performing the additional folding process. Inevitably the time of the additional folding process is long. Further, the apparatus is large and its manufacturing cost is high, because it must have a transport path or space for stacking the preceding sheet.

On the other hand, in the booklet additional-folding mechanism disclosed in Patent Document 2, rollers are supported on the roller supporting member for a distance longer than the folding line of the sheet. To perform the additional folding, it suffices to move the rollers along the folding line, by a distance a little longer than the pitch at which the rollers are arranged. The time required for the additional folding can therefore be shorter than the time required in the sheet folding apparatus disclosed in Patent Document 1. However, the spaces provided, at the sides of the sheet, for allowing the roller supporting member to move, are large, inevitably increasing the size of the sheet folding apparatus and the cost of the rollers. Further, since the force of pressing the roller supporting member onto the folding line of the sheet is dispersed, the pressure one roller applies to the folding line decreases. To apply a sufficient pressure to the folding line of the sheet, a large force must be exerted to the roller supporting member.

SUMMARY OF THE INVENTION

This invention has been made to solve the problems with the prior art. The object of the invention is to provide a sheet pressing apparatus which is not large, which operates at low cost and which can perform additional folding at high efficiency.

In view of the object specified above, this invention provides a sheet pressing apparatus designed to perform an additional folding on a sheet already folded and having a folding line made in a folding process. The sheet pressing apparatus comprises: an inlet port configured to receive a sheet having a folding line made in a folding process and transported in a prescribed transport direction; a supporting member arranged downstream from the inlet port in the prescribed transport direction and able to move in a prescribed direction; a plurality of first pressing members arranged and supported along the folding line of the sheet, in a prescribed arrangement region of the supporting member; a second pressing member arranged, opposing the first pressing members, and configured to cooperate with the first pressing members to press the sheet at the folding line; a first drive mechanism configured to move the first pressing members with respect to the second pressing member between a pressing position where the folding line is pressed between the first pressing members and the second pressing member, and a retreat position where the first pressing members are spaced apart from the second pressing member, moving away from the pressing position, when the supporting member is moved with respect to the second pressing member; and a second drive mechanism configured to move the first pressing members to the pressing position, with respect to the second pressing member, and then to move the supporting member with respect to the second pressing member, thereby moving the first pressing members along the folding line with respect to the second pressing member. The arrangement region has such a length that when the first drive mechanism causes the first pressing members to move relative to the second pressing member from the retreat position to the pressing position, one end of the folding line is arranged between two adjacent first pressing members located at one position and the first pressing member at the other end position is arranged on the folding line.

In the sheet pressing apparatus, the folding line made on the sheet transported is arranged between the first pressing members and the second pressing member. The first pressing members moved to the pressing position are then moved with respect to the second pressing member, thereby performing the additional folding at the folding line of the sheet. If the first pressing members are moved along the folding line with respect to the second pressing member to perform the additional folding, the supporting member must be moved along the folding line for a distance equal to or longer than the distance between the adjacent first pressing members, not to provide a region where the sheet cannot be pressed at the folding line. If the ends of the folding line are arranged, as in the sheet pressing apparatus, between the two first pressing members located at one position upstream in the moving direction, the first pressing members can reliably press, namely, additionally fold the sheet at the ends of the folding line as the first pressing members and the supporting member are moved along the folding line for the shortest distance required. Even if the first pressing members at the other end position are arranged on the folding line of the sheet and do not exist, in part, in the arrangement region on the downstream side in the moving direction along the folding line, the sheet can be pressed by the first pressing members at the end position as a smallest number of required move along the folding line. Hence, the additional folding can be performed without lengthening the process time, unlike in the case where the arrangement region covers the entire folding line of the sheet. Further, when the arrangement region is made to cover the entire folding line of the sheet, there arises a need for securing a space that is enough to accommodate at least the part of the arrangement region that is disposed outside the folding line of the sheet on the upstream side as viewed in the moving direction of the additional folding rollers that is running along the folding line and on the side of the folding line of the sheet and, at the same time, also for securing a space on the downstream side as viewed in the moving direction and on a lateral side of the folding line of the sheet that is at least enough to allow the movement along the folding line of the sheet of the supporting member for pressing the folding line in addition to the part of the arrangement region disposed outside the folding line of the sheet. However, in the sheet pressing apparatus described above, the initial position of the leading first pressing member that is moving toward the folding line as viewed in the moving direction is located on the folding line of the sheets and hence the arrangement region is not located outside the folding line of the sheet as viewed in the moving direction. Therefore, the sheet pressing apparatus can be downsized to the extent of non-existence of the arrangement region disposed outside the folding line of the sheet at the initial position of the first pressing members for moving along the folding line. Moreover, when the first drive mechanism moves the first pressing members from the retreat position to the pressing position with respect to the second pressing member, one end of the folding line is arranged between the two adjacent first pressing members at one position, and the first pressing member at the other end position is arranged at the folding line. The arrangement region can therefore be shorter than in the case where it can cover the entire folding line of the sheet. The first pressing members arranged in the arrangement region can be reduced in number, decreasing the manufacturing cost of the apparatus and increasing the force acting on each first pressing member. This ultimately achieves an efficient sheet folding.

In the sheet pressing apparatus, the arrangement region should better be shorter than the folding line of the sheet. If so, the operating efficiency of the apparatus can be enhanced even more.

Further, the first pressing members are arranged at regular intervals in the arrangement region, and the arrangement region is shorter than the folding line of the sheet by the distance between adjacent first pressing members. Therefore, if the first pressing member at one position is arranged near one end of the folding line of the sheet, the sheet can be additionally folded along the entire folding line by moving the first pressing members, in smallest number required for additional folding, by a distance slightly longer than the distance between any two adjacent first pressing members. The apparatus can therefore be made small, can suppress the increase in the additional-folding process time and can perform an efficient additional sheet folding.

In the case described above, the apparatus may further comprise a contact and a guide groove for guiding the supporting member along the folding line at the pressing position. The guide groove has a region that extends in the direction of the folding line for a distance longer than the distance between any two adjacent first pressing members. In this case, the supporting member moves a distance equal to or longer than one pitch of the adjacent first pressing members, and the additional folding can reliably be performed over the entire folding line of the sheet between the first pressing members and the second pressing member.

The sheet pressing apparatus may further comprise a control section configured to control the operation thereof. In the apparatus, the sheet has first and second folding lines and the retreat position includes first and second retreat positions different from each other. The control section first causes the second drive mechanism to move, at the pressing position, the first pressing members forward along the first folding line with respect to the second pressing member. The control section then causes the first drive mechanism to move the first pressing members forward to the first retreat position with respect to the second pressing member, to move the sheet in the transport direction and to stop the second folding line between the first pressing members and the second pressing member. Further, the control section causes the first drive mechanism to move the first pressing members to the pressing position with respect to the second pressing member and causes the second drive mechanism to move, at the pressing position, the first pressing members backward along the second folding line with respect to the second pressing member. Finally, the control section causes the first drive mechanism to move the first pressing members to the second retreat position with respect to the second pressing member. Since the control section so functions, the sheet can be additionally folded at two folding lines as the first pressing members move back and forth along the folding lines. The increase in the folding process time can therefore be suppressed even if a plurality of folding lines are made as in Z folding, inner double folding and outer double folding, unlike in the conventional apparatus in which the first pressing members are moved back and forth with respect to one folding line.

In an embodiment of this invention, a bias member may be provided between the supporting member and the first pressing members and may bias the first pressing members toward the folding line. In this case, the change in the sheet thickness at the folding line can be cancelled out. Further, even if the supporting member inclines and moves, a uniform pressing force can be applied to the sheet along the folding line.

Moreover, this invention provides an image forming system which comprises an image forming apparatus configured to form an image on a sheet and transport the image-formed sheet; a sheet processing apparatus configured to perform a folding process on the sheet delivered from the image forming apparatus; and a sheet pressing apparatus of the type described above.

This invention can perform additional folding without increasing the additional-folding process time, unlike in the case where the arrangement region covers the entire folding line of the sheet. Further, the space provided beside the folding line of the sheet in order to allow the first pressing members to move with respect to the second pressing member can be small, and the sheet pressing apparatus can therefore be made small. Moreover, since the arrangement region can be shorter than in the case where it can cover the entire folding line of the sheet, the number of first pressing members required can be proportionally reduced to lower the cost related to the first pressing members, and the force acting on each first pressing member can increase to perform the additional folding at high efficiency.

BRIEF DESCRIPTION OF THE DRAWINGS

FIG. 5A showing a sheet having its first folding line received in the additional folding section, said first folding line located at the front edge of the sheet as viewed in the sheet transport direction; FIG. 5B showing the sheet pressed, at its first folding line, by the additional folding rollers moved to the pressing position, FIG. 5C showing the additional folding rollers being moved along the first folding line at the pressing position shown in FIG. 5B, and FIG. 5D showing the additional folding rollers moved to the first retreat position from the position shown in FIG. 5C;

FIG. 6E showing a sheet having its second folding line received in the additional folding section, said second folding line located at the rear edge of the sheet as viewed in the sheet transport direction; FIG. 6F showing the sheet pressed, at its second folding line, by the additional folding rollers moved to the pressing position, FIG. 6G showing the additional folding rollers being moved along the second folding line at the pressing position shown in FIG. 6F, and FIG. 6H showing the additional folding rollers moved to the second retreat position from the position shown in FIG. 6G;

DETAILED DESCRIPTION OF THE PREFERRED EMBODIMENTS

Figure 1:
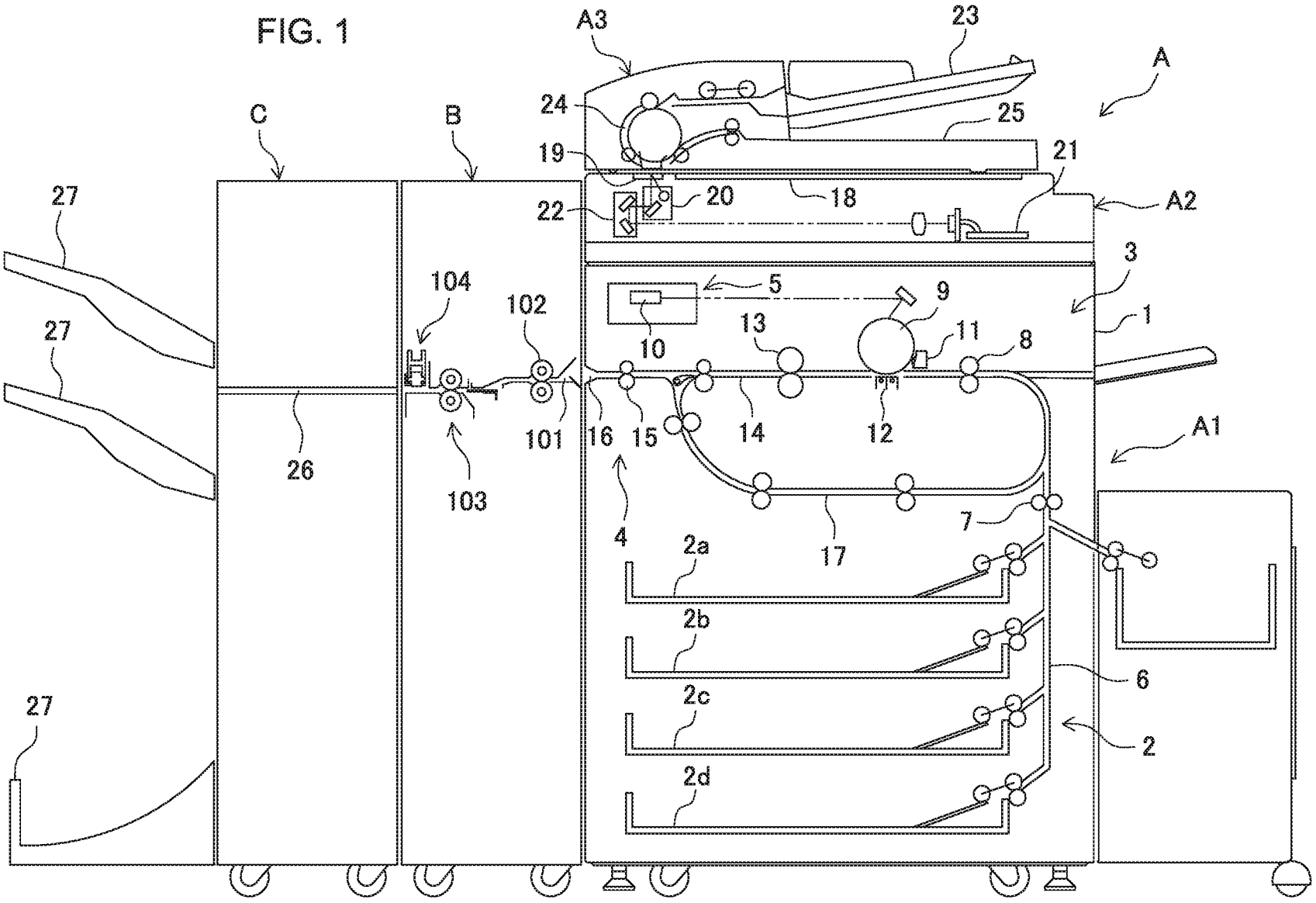
FIG. 1 is a diagram showing the overall configuration of an image forming system having a sheet pressing apparatus according to the present invention.

Hereinafter, preferred embodiments of the present embodiments will be described with reference to the accompanying drawings. Throughout the drawings, the same reference numerals are used to designate the same or similar components.

First, with reference to FIG. 1, the entire configuration of an image forming system provided with a folding process apparatus having an additional folding unit as a sheet pressing apparatus according to the present invention will be described. The image forming system includes an image forming apparatus A, a folding process apparatus B and a post-processing apparatus C. A sheet S on which an image is formed by the image forming apparatus A is subjected to folding processing by the folding process apparatus B and is thereafter subjected to stapling and aligning processing as needed by the post-processing apparatus C on the downstream side. The resultant sheet S is discharged to a storage tray 27 on the downstream side. The image forming system can include devices of various structures, such as a copier, a printer and a press. Hereinafter, the image forming apparatus A, folding process apparatus B and post-processing apparatus C will be individually described in detail.

[Image Forming Apparatus]

As illustrated in FIG. 1, the image forming apparatus A includes an image forming unit A1, an image reading unit A2 and a document feeding unit A3. The image forming unit A1 has, in a housing 1, a sheet feeding part 2, an image forming part 3, a sheet discharge part 4 and a data processing part 5.

The sheet feeding part 2 includes a plurality of cassettes 2*a*, 2*b*, 2*c* and 2*d*. The cassettes 2*a*, 2*b*, 2*c* and 2*d* can individually store therein sheets S of different standard sizes respectively preselected. Each of the cassettes 2*a*, 2*b*, 2*c*, and 2*d* incorporates a separating mechanism for separating the sheets S therein one from another and a sheet feeding mechanism for delivering the sheet S. The thus configured sheet feeding part 2 delivers the sheet S of a size specified by a main body control part (not illustrated) to a sheet feeding path 6. In the sheet feeding path 6, a transporting roller 7 and a registration roller 8 are provided. The transporting roller 7 is disposed at the intermediate portion of the sheet feeding path 6 and configured to convey downstream the sheet S supplied from the plurality of cassettes 2*a*, 2*b*, 2*c* and 2*d*. The registration roller 8 is disposed at the end portion of the sheet feeding path 6 and is configured to align the sheets S at their leading ends. The sheets S aligned at their leading ends by the registration roller 8 are fed to the image forming part 3 on the downstream side at a predetermined timing.

The image forming part 3 may be configured at least to form an image on the sheet S fed from the sheet feeding part 2, and various image forming mechanisms can be adopted as the image forming part 3. In the illustrated embodiment, an electrostatic type image forming mechanism is exemplified as the image forming part 3. However, the image forming part 3 is not limited to such an electrostatic type image forming mechanism as illustrated, but an inkjet type image forming mechanism, an offset type image forming mechanism and the like can be adopted as the image forming part 3.

The image forming part 3 illustrated in FIG. 1 is provided with a photoreceptor 9 (drum, belt) and a light emitter 10 that emits optical beam to the photoreceptor 9, and a developer 11 and a cleaner (not illustrated) are disposed around the rotating photoreceptor 9. The illustrated example is a monochrome print mechanism, wherein a latent image is optically formed on the photoreceptor 9 by the light emitter 10, and toner ink is applied to the latent image by the developer 11. The ink image (ink toner) applied onto the photoreceptor 9 is image-transferred, by a transfer charger 12, onto the sheet S fed from the sheet feeding part 2, and the image-transferred sheet S is subjected to image-fixing by a fixing roller 13. The resultant sheet S is fed to a sheet discharge path 14. Further, a circulation path 17 is provided in the image forming part 3, wherein the sheet S from the sheet discharge path 14 is turned upside down in a switch-back path and is fed once again to the registration roller 8, then subjected to image formation on the back surface, and fed to the sheet discharge path 14. The sheet discharge path 14 has a sheet discharge roller 15, and a sheet discharge port 16 is formed at the end thereof. The image-formed sheet S is conveyed by the sheet discharge roller 15 to the folding process apparatus B through the sheet discharge port 16.

The image reading unit A2 is provided above the thus configured image forming unit A1. The image reading unit A2 is configured to optically read a document image formed in the image forming part 3. Further, the document feeding unit A3 is mounted on the image reading unit A2.

The image reading unit A2 includes first and second platens 18 and 19 each made of a transparent glass, a reading carriage 20, a light source mounted on the reading carriage 20, a photoelectric conversion element 21 and a reduction optical system 22 constituted by combining a mirror and a lens. In the image reading unit A2, the image on the document sheet S placed on the first platen 18 is irradiated with light from the light source while the reading carriage 20 is moved along the first platen 18, and reflected light from the image on the document sheet S is guided by the reduction optical system 22 to the photoelectric conversion element 21, whereby the image on the document sheet S is read. The photoelectric conversion element 21 converts read image data into an electric signal and transfers the obtained electric signal to the image forming part 3.

The document feeding unit A3 includes a sheet feeding tray 23, a sheet feeding path 24 and a sheet discharge tray 25. In the document feeding unit A3, documents placed on the sheet feeding tray 23 are fed one by one along the sheet feeding path 24, made to pass on the second platen 19, and discharged to the sheet discharge tray 25. When the document fed from the sheet feeding tray 23 and passing on the second platen 19 is read, the reading carriage 20 is stopped ahead of time below the second platen 19, and image data is generated from the image passing on the second platen 19.

[Post-Processing Apparatus]

The post-processing apparatus C is connected to the downstream side of the folding process apparatus B connected to the image forming apparatus A and is configured to receive the sheet S (that has been subjected to folding processing or has not been subjected thereto) from the folding process apparatus B and apply stapling processing and aligning processing as needed.

A post-processing path 26 is provided inside the post-processing apparatus C, and post-processing units (not illustrated) such as a stapling unit and an aligning unit are disposed along the post-processing path 26. The post-processing apparatus C receives the sheet S discharged from the image forming apparatus A through the folding process apparatus B, applies, as needed, stapling processing and aligning processing to the received sheet S by the post-processing units such as the stapling unit and the aligning unit, and discharges the resultant sheet S to the storage tray 27 for storage.

[Folding Process Apparatus]

The folding process apparatus B connected to the image forming apparatus A is configured to receive the image-formed sheet S discharged from the sheet discharge port 16 of the image forming apparatus A and apply folding processing to the sheet S.

Figure 2:
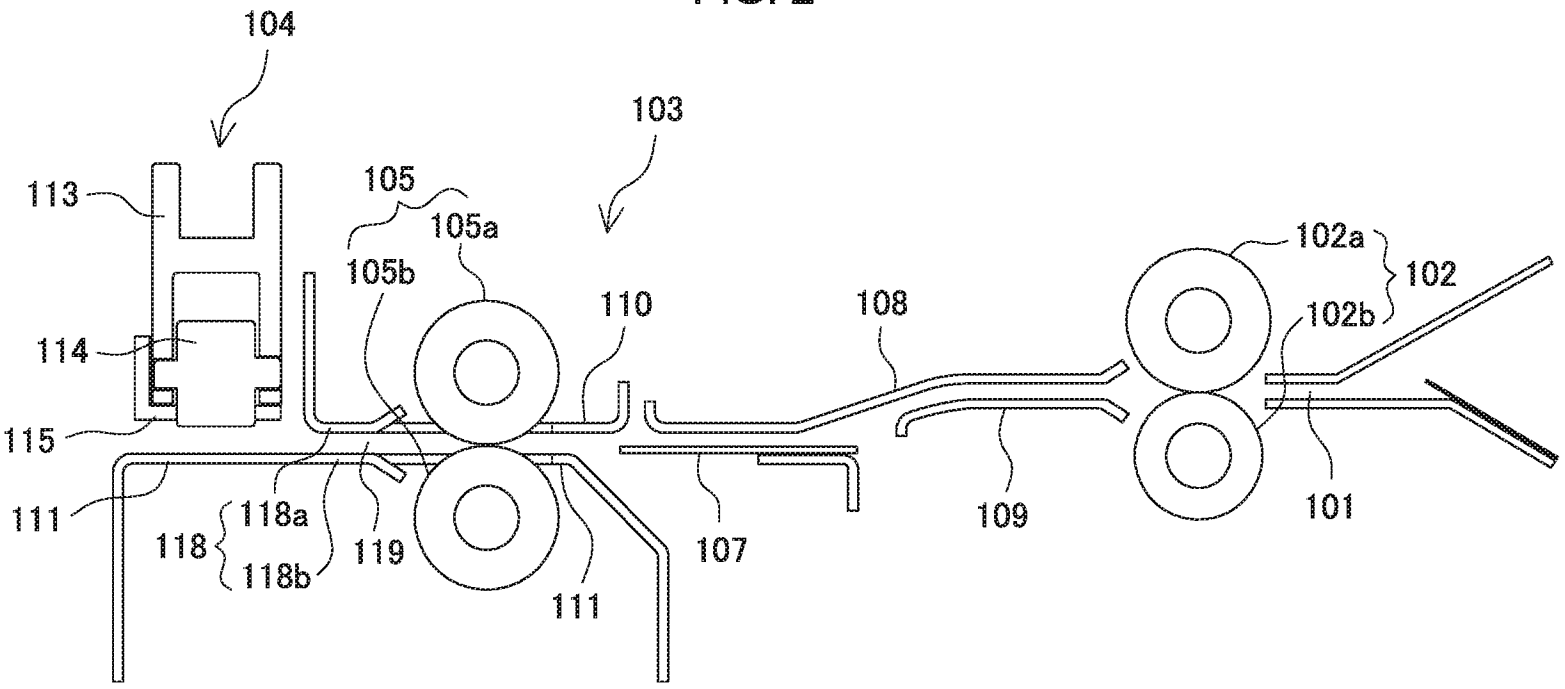
FIG. 2 is a diagram illustrating the major components of the folding process mechanism and additional folding unit (equivalent to a sheet pressing apparatus) of the folding process apparatus shown in FIG. 1.

FIG. 2 illustrates the internal configuration of the folding process apparatus B. The folding process apparatus B incorporates a transport path 101 that extends in almost horizontal direction. On the transport path 101, one or more transporting roller pairs 102 and a folding process mechanism 103 are provided. The folding process mechanism 103 is arranged downstream relative to the transporting roller pair 102. Further, an additional folding unit 104 equivalent to a sheet pressing apparatus of this invention is provided at the end of the downstream transport path 101 of the folding process mechanism 103. In the folding process apparatus B, the folding process mechanism 103 folds the sheet S being transported in the transport path 101, and the additional folding unit 104 then performs the additional folding process on the sheet S. Then, the sheet S can be transferred to the post-process apparatus C.

As illustrated in FIG. 1, the transport path 101 is disposed so as to be connected to the sheet discharge port 16 of the image forming apparatus A, whereby the sheet S discharged from the sheet discharge port 16 can be carried in the folding process apparatus B through the transport path 101. A discharge port of the additional folding unit 104 is also connected to the post-processing path 26 of the post-processing apparatus C, whereby the sheet S discharged from the additional folding unit 104 can be carried in the post-processing apparatus C through the post-processing path 26.

The transporting roller pair 102 is formed of a rubber roller and includes an upper transporting roller 102*a* disposed on the upper side and a lower transporting roller 102*b* disposed on the lower side so as to be opposed to the upper transporting roller 102*a*. In the present embodiment, the upper transporting roller 102*a* is connected to a not-shown transporting roller drive motor, so as to be rotated with the rotation of the transporting roller drive motor. On the other hand, the lower transporting roller 102*b* is brought into press-contact with the upper transporting roller 102*a* by biasing force of a not-shown spring, so as to follow the rotation of the upper transporting roller 102*a*. However, the transporting roller pair 102 is not limited to the above-described configuration and may have any appropriate configuration as long as it can convey the sheet S.

The folding process mechanism 103 is constituted of a folding roller pair 105 and a push plate 107. The folding roller pair 105 is formed of a rubber roller and includes an upper folding roller 105*a* disposed on the upper side and a lower folding roller 105*b* disposed on the lower side so as to be opposed to the upper folding roller 105*a*. The lower folding roller 105*b* is brought into press-contact with the upper folding roller 105*a* by biasing force of a not-shown spring. The upper folding roller 105*a* and the lower folding roller 105*b* are connected in common to a not-shown folding roller drive motor and are rotated in the mutually opposite directions with the rotation of the folding roller drive motor. The push plate 107 is disposed between the transporting roller pair 102 and the folding roller pair 105 and is connected to a not-shown push plate drive motor. The push plate 107 is configured to be moved in parallel to the transport path on the upstream side of the folding roller pair 105 with the driving of the push plate drive motor.

In the transport path 101 between the transporting roller pair 102 and the folding roller pair 105, an upper transport guide 108, a lower transport guide 109, an upper folding guide 110 and a lower folding guide 111 are provided.

The upper transport guide 108 is formed so as to extend from a location immediately downstream of the transporting roller pair 102 to a location above the push plate 107 so as to guide the leading end of the sheet S from the transporting roller pair 102 to the push plate 107. The upper transport guide 108 regulates the direction of the flow of the sheet S conveyed in the transport path 101. The upper transport guide 108 is disposed above the transport path 101 and has a shape bent downward toward the downstream side. The upper folding guide 110 is disposed between the upper transport guide 108 and the folding roller pair 105 and extends to a location immediately upstream of the folding roller pair 105 so as to guide the leading end of the sheet S and a folded part (to be described later) of the sheet S to the folding roller pair 105. The upper folding guide 110 regulates the direction of the flow of the sheet S in the folding process mechanism 103 and is disposed above the transport path 101 on the downstream side of the upper transport guide 108.

The lower transport guide 109 regulates the direction of the flow of the sheet S conveyed in the transport path 101. The lower transport guide 109 is disposed below the transport path 101 and has a shape bent downward toward the downstream side like the upper transport guide 108. The lower transport guide 109 is terminated in front of the push plate 107, so that a vacant space is formed on the downstream side of the lower transport guide 109. The lower folding guide 111 is disposed downstream of the push plate 107 and extends over the upstream and downstream sides of the folding roller pair 105. A part of the lower folding guide 111 on the upstream side relative to the folding roller pair 105 has a horizontal surface for guiding the leading end of the conveyed sheet S and a folded part (to be described later) of the sheet S to a nip of the folding roller pair 105 and an inclined surface for easily guiding the leading end and the folded part of the sheet S to the horizontal surface.

The push plate 107 can be moved horizontally by a push plate driving device (not shown) controlled by the control section. The push plate 107 is arranged, filling up the space between the lower transport guide 109 and the lower folding guide 111 when the transporting roller pair 102 transports the sheet S in the transport path 101 to the folding roller pair 105. The push plate 107 can therefor guide the front edge of the sheet S to the lower folding guide 111. When the control section determines that the front edge of the sheet S is nipped by the folding roller pair 105, it moves the push plate 107 in the horizontal direction to the retreat position below the lower transporting guide 109, providing a loop forming space between the lower transporting guide 109 and the lower folding guide 111. Then, the sheet S is transported by a prescribed distance, with its front edge nipped by the folding roller pair 105. At this time, the middle part of the sheet S warps downward in the loop forming space, forming a loop. In this state, the push plate 107 is moved in horizontal direction, from the retreat position to the folding roller pair 105, forming a bent portion of the sheet. After the push plate 107 reaches a position in front of the folding roller pair 105, the folding roller pair 105 is driven, transporting the sheet S further, thereby forming a first folding line 132 on the sheet S. Then, the push plate 107 is moved to the retreat position and the folding roller pair 105 transports the sheet S and nips the looped part of the sheet, thereby forming a second folding line 133. The sheet S is thereby Z-folded and transported to the downstream side.

Figure 3:
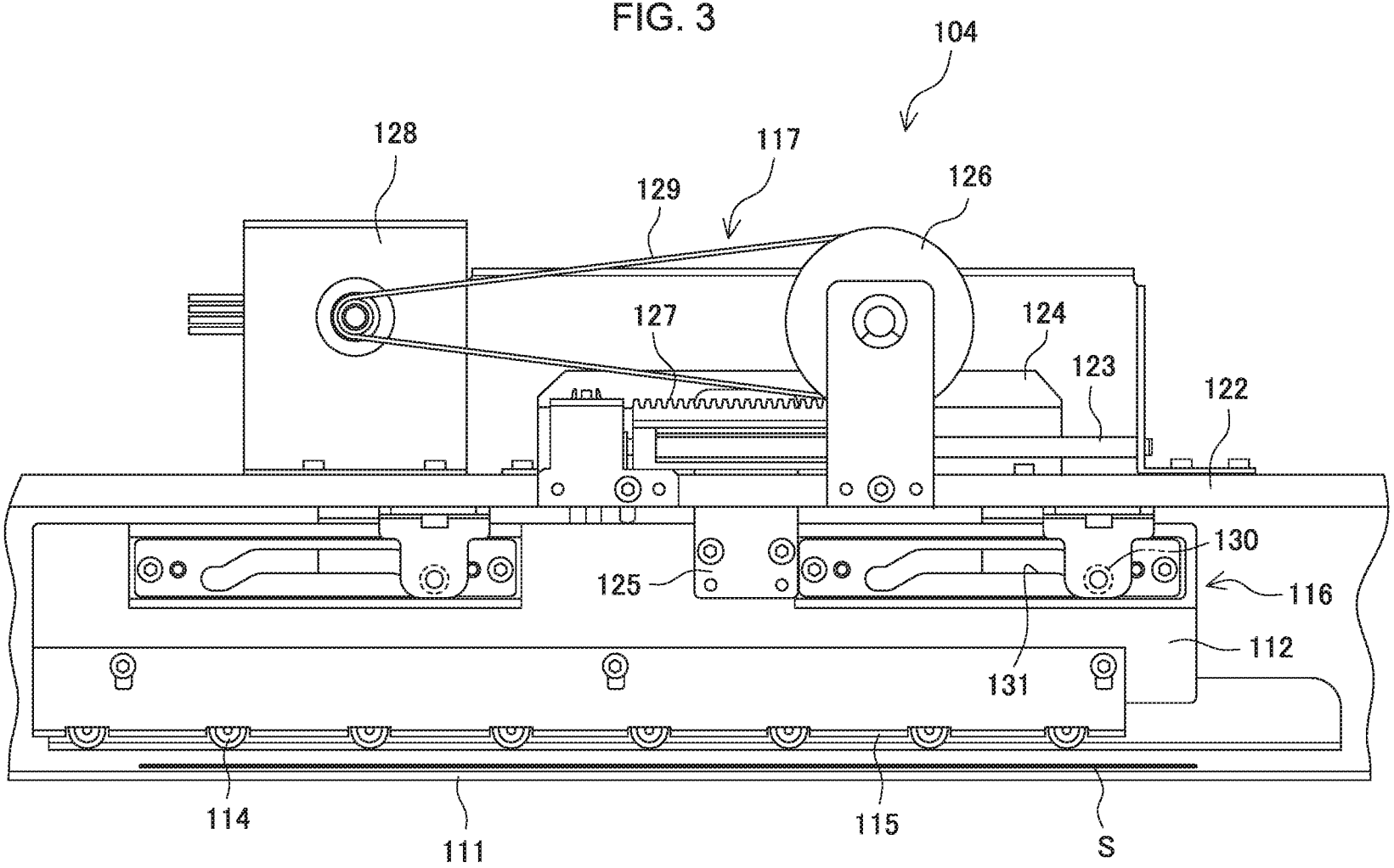
FIG. 3 is shows the additional folding unit of the sheet pressing apparatus shown in FIG. 1, as viewed from an outlet port.

With reference to FIG. 3, the configuration of the additional folding unit 104 will be described. The additional folding unit 104 is arranged downstream from the folding roller pair 105 and above the lower folding guide 111 as viewed in the transport direction of the sheet S. The additional folding unit 104 comprises a movable supporting member 112, a plurality of additional folding rollers 114, a restriction member 115, a first drive mechanism 116, and a second drive mechanism 117. The movable supporting member 112 can move, and supports the additional folding rollers 114. The restriction member 115 is secured to the supporting member 112. The first drive mechanism 116 moves the supporting member 112 in two directions, toward and away from the lower folding guide 111. The second drive mechanism 117 moves the supporting member 112 in the horizontal direction, along the folding line of the sheet S. Those parts of the upper and lower folding guides 110 and 111 arranged one above the other and opposing each other, which lie downstream relative to the folding roller pair 105, function as a pair of transport guides 118 for guiding the sheet S into the additional folding unit 104. The upstream ends of the transport guides 118 define the inlet port 119 of the additional folding unit 104. The additional folding rollers 114 supported by the supporting member 112 as described above and the lower folding guide 111 constitute an additional folding section.

The additional folding rollers 114 are supported on the supporting member 112 and spaced equally from one another in a row that extends in the direction of the folding line of the sheets within the pressing-member region, and can rotate around an axis that extends in the direction of transporting each sheet S (namely, in the direction parallel to the upper surface of the lower folding guide 111 and perpendicular to the folding line of the sheet S). The first drive mechanism 116 moves the supporting member 112 supporting the additional folding rollers 114, to and from the lower folding guide 111. The additional folding rollers 114 are therefore moved to and from the lower folding guide 111. Hence, the folding line of the sheet S located between each additional folding roller 114 and the lower folding guide 111 can be moved between the sheet-pressing position where the sheet S is pressed by each additional folding rollers 114 and the lower folding guide 111 and the retreat position to which the additional folding rollers 114 are moved from the sheet S and from the sheet-pressing position. The second drive mechanism 117 can move the supporting member 112 in the horizontal direction (i.e., in the left-right direction in FIG. 3) at the pressing position, thereby to move the additional folding rollers 114 along the folding line of the sheet S. The additional folding rollers 114 and the lower folding guide 111 contact directly if the sheet S does not exist between the rollers 114, on one hand, and the guide 111, on the other. The length of the pressing-member region (i.e., the distance between the additional folding rollers 114 arranged at two end positions of the region) is so preset that, when the additional folding rollers 114 are moved from the retreat position to the pressing position, one edge of the folding line of the sheet S (i.e., the edge upstream in the moving direction of the additional folding rollers 114) may be arranged between two adjacent additional folding rollers 114 arranged side by side at one end position of the pressing-member region, and that the additional folding rollers 114 at the other end position of the pressing-member region may be arranged on the folding line of the sheet S. The one end position of the pressing-member region cited above refers to a part of the pressing-member region that extends from a center portion of the region to an end part thereof as viewed in the direction in which the plurality of additional rollers 114 are arranged. The other end position of the pressing-member region cited above refers to the opposite part of the pressing-member region that extends from the center portion of the region to another end part thereof in the direction in which the plurality of additional rollers 114 are arranged. More preferably, the length of the pressing-member region is so preset that, when the additional folding rollers 114 are moved from the retreat position to the pressing position, one edge of the folding line of the sheet S may be arranged between two adjacent additional folding rollers 114 arranged side by side at one end position, and that the additional folding rollers 114 at the other end position may be arranged on the folding line of the sheet S. Preferably, as in the embodiment illustrated, the pressing-member region, namely the distance between the additional folding rollers 114 arranged at the respective end positions of the region, should be shorter than the folding line of the sheet S transported to the additional folding unit 104 by the pitch at which the additional folding rollers 114 are arranged (namely, by the gap between any two adjacent additional folding rollers). In this case, the number of additional folding rollers 114 required can be reduced, ultimately decreasing the cost concerning the additional folding rollers 114. Since the number of additional folding rollers 114 supported by the supporting member 112 is decreased, the pressure each additional folding roller 114 exerts to the sheet S to apply the same force to the supporting member 112 increases. This enhances the additional folding efficiency, using a smaller force.

In the additional folding unit 104, the additional folding rollers 114 are arranged at the retreat position or at a sheet-receiving position, separating rather toward the retreat position side than the sheet-pressing position. After the sheet S is received into the additional folding unit 104, a sheet-position detecting means (not shown) arranged upstream relative to the folding roller pair 105 detects the position of the sheet S, determining that the folding line of the sheet S has reached a position below the additional folding rollers 114. At this time, the sheet S is stopped, and the first drive mechanism 116 moves the additional folding rollers 114 to the sheet-pressing position with respect to the lower folding guide 111. When the additional folding rollers 114 are moved to the sheet-pressing position, the folding line of sheet S is transported into the additional folding unit 104. At this time the sheet S has its one end (i.e., end upstream in the direction along the folding line) arranged between the two additional folding rollers 114 which are positioned at one position of the pressing-member region, and has its other end (i.e., end downstream in the direction along the folding line) arranged outside the pressing-member region (namely, outside the additional folding roller 114 at the other side of the pressing-member region). Then, the second drive mechanism 117 moves the additional folding rollers 114 at the pressing position, along the folding line of the sheet S with respect to the lower folding guide 111. The additional folding rollers 114 therefore press the sheet S all along the folding line, intensifying the folding line. Thus, each additional folding roller 114 and the lower folding guide 111 function as sheet pressing members.

The restriction member 115 secured to the supporting member 112 and having a substantially L-shaped cross section is arranged outside the additional folding rollers 114 at the end positions and between the adjacent additional folding rollers 114. The restriction member 115 is arranged at such a restricting position that the distance d1 between the bottom of the restriction member 115 (i.e., the surface opposing the lower folding guide 111) and the upper surface of the lower folding guide 111 is shorter than the height of an ordinary transport path, e.g., the distance d2 between the transport guides 118 (i.e., upper transport guide 118*a* and lower transport guide 118*b*) that constitute the transport path connected to the inlet port 119 of the additional folding unit 104. The restriction member 115 moves, together with the supporting member 112, along the folding line of the sheet S, while maintaining the distance d1. The distance d1 between the bottom of the restriction member 115 and the upper surface of the lower folding guide 111 is preset to such a value that the restriction member 115 and the lower folding guide 111 may not directly contact. Therefore, before the additional folding rollers 114 press the sheet S, the restriction member 115 presses the sheet S, moving the folding line to a position lower than the space between the upper transport guide 118*a* and the lower transport guide 118*b*. In this state, the additional folding rollers 114 can press the sheet at the folding line, performing the additional folding.

The gap between the additional folding rollers 114 and the lower folding guide 111 and the gap between the restriction member 115 and the lower folding guide 111 are maintained constant along the entire folding line of the sheet S.

Figure 4:
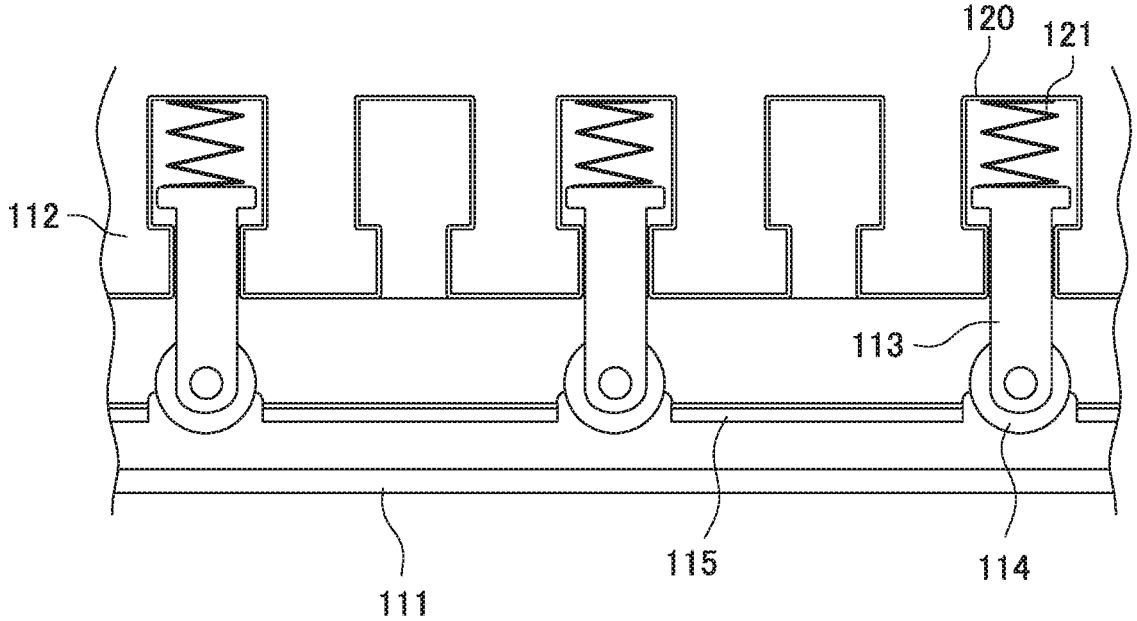
FIG. 4 is a diagram for describing a mechanism provided in the additional folding unit shown in FIG. 3 and configured to bias additional folding rollers toward a sheet.

As shown in FIG. 4, the additional folding rollers 114 are rotatably attached to auxiliary members 113 which can move with respect to the supporting member 112. The supporting member 112 has a spring-holding part 120. Preferably, a spring 121 should be arranged between the spring-holding part 120 and the upper end of the auxiliary member 113, and biases the additional folding rollers 114 toward the lower folding guide 111. Therefore, when the supporting member 112 and the restriction member 115 secured to the supporting member 112, of the additional folding unit 104 move down toward the additional folding unit 104, the additional folding rollers 114 stop moving when they contact, through the sheet S, the lower folding guide 111, and the supporting member 112 and the restriction member 115 can further move down by the urging force of the spring 121. The supporting member 112 and the restriction member 115 can be stopped when the distance between the bottom of the restriction member 115 and the upper surface of the lower folding guide 111 changes to a desirable value. If each auxiliary member 113 is biased by one spring 121, each additional folding roller 114 can apply a constant pressure to the sheet S along the folding line even if the supporting member 112 inclines a little and moves along the folding line of the sheet S. This can prevent the pressure applied along the folding line from changing, suppressing non-uniform additional folding.

The configurations of the first and second drive mechanisms 116 and 117 of the embodiment illustrated herein will be described in detail.

The supporting member 112 of the additional folding unit 104 is secured by a bracket 125 to a slider 124 that can move on a guide rail 123 laid on, for example, the housing 122 of the folding process apparatus B, and can move up and down and can move in horizontal direction in unison with the slider 124. The slider 124 has a rack 127 that meshes with a pinion (not shown) that rotates together with a pulley 126. An additional-folding drive motor 128 is driven. The drive force of the motor 128 is transmitted to the pulley 126 by a belt 129, rotating the pulley 126. The slider 124 can therefore be moved in the horizontal direction, on the guide rail 123.

The movable supporting member 112 has a cam groove 131, which holds a contact 130 attached to the housing 122 or the like of the folding process apparatus B. As the supporting member 112 moves in the horizontal direction, the cam groove 131 engaged with the contact 130 is moved. In other words, when the supporting member 112 moves, it is guided to follow the shape of the cam groove 131. The cam groove 131 includes a first bottom horizontal part, a first inclining part, a top horizontal part, a second inclining part, and a second bottom horizontal part. The first horizontal bottom part extends almost horizontally. The first inclining part inclines upward, extending from the end of the first horizontal bottom part. The top horizontal part extends from the end of the first inclining part in a substantially horizontal direction. The second inclining part inclines downward, extending from the end of the top horizontal part. The second bottom horizontal part extends almost horizontally, from the end of the second inclining part. The slider 124 may move the supporting member 112 with respect to the housing 122 in the horizontal direction as shown in FIG. 3, while keeping the contact 130 engaged with the first and second inclining parts of the cam groove 131. The supporting member 112 is thereby moved toward or away from the supporting member 112, namely in the vertical direction (FIG. 3). Thus, the guide rail 123, the slider 124, the bracket 125, the pulley 126, the rack 127, the additional-folding drive motor 128, the belt 129, the contact 130, and the first and second inclining parts of the cam groove 131 constitute the first drive mechanism 116. While the contact 130 remains engaged with the top horizontal part of the cam groove 131, the slider 124 may move the supporting member 112 in the horizontal direction (FIG. 3) with respect to the housing 122. Then, the supporting member 112 and the additional folding rollers 114 supported by the supporting member 112 move with respect to the lower folding guide 111, along the folding line of the sheet S, in the horizontal direction (FIG. 3). Thus, the guide rail 123, the slider 14, the bracket 125, the pulley 126, the rack 127, the additional-folding drive motor 128, the belt 129, the contact 130, and the top horizontal part of the cam groove 131 constitute a second drive mechanism 117. In the embodiment illustrated herein, the contact 130 is fixed to the housing 122 and the cam groove 131 is cut in the supporting member 112. Needless to say, the contact 130 may be secured to the supporting member 112 and the cam groove 131 may be cut in the housing 122.

In the embodiment illustrated herein, the additional folding rollers 114 are arranged, one spaced from another, at a specific distance. Therefore, in order to press the sheet S between the additional folding rollers 114 and lower folding guide 111 all along the folding line located between the adjacent additional folding rollers 114, the additional folding rollers 114 must be moved at the pressing position by a distance not less than the interval between two adjacent folding rollers 114 (namely one pitch of the rollers 114) along the folding line with respect to the lower folding guide 111. In the first drive mechanism 116 described above, the slider 124 is moved in the horizontal direction while keeping the contact 130 engaged with the first inclining part of the cam groove 131, and the additional folding rollers 114 supported by the supporting member 112 are thereby moved to the pressing position, approaching the lower folding guide 111. Further, in the second drive mechanism 117 so constituted as described above, the slider 124 is moved in the horizontal direction, while the contact 130 is held in engagement with top horizontal part of the cam groove 131, thereby moving the additional folding rollers 114 supported by the supporting member 112 along the folding line at the pressing position. Therefore, the top horizontal part of the cam groove 131 have a length equal to or greater than one pitch of the adjacent additional folding rollers 114.

With reference to FIG. 5A through FIG. 8H, the additional folding unit 104 of the embodiment illustrated will be described in detail, on the assumption that a sheet S which has been Z-folded by the folding process mechanism 103 and which therefore has first and second folding lines 132 and 133, has been transported into the additional folding unit 104.

Figure 5A:
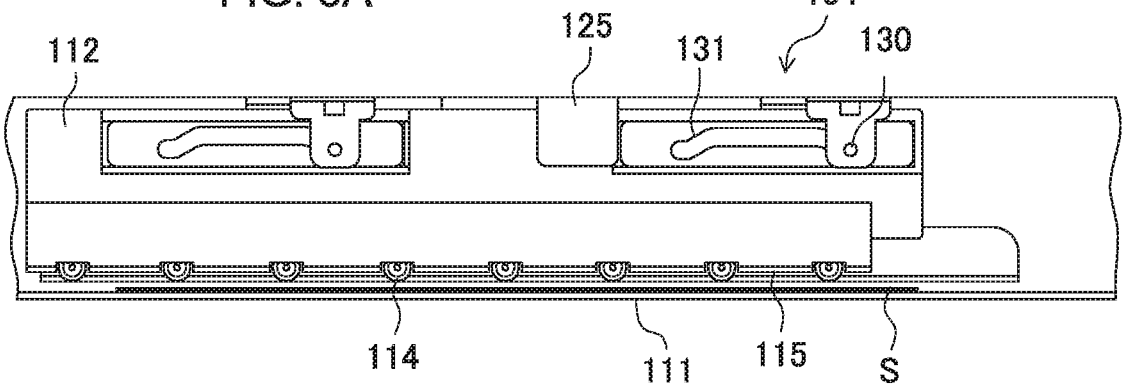
FIGS. 5A to 5D illustrate how the additional folding section operates in the additional folding unit to perform an additional folding process on the sheet.
Figure 7A:
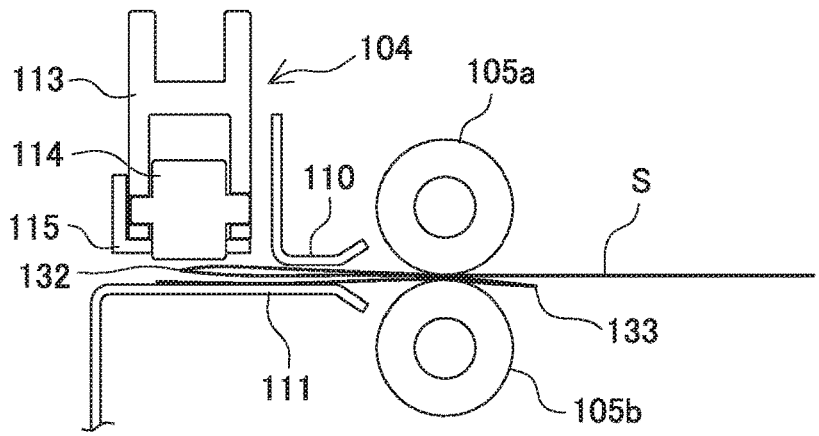
FIGS. 7A to 7D illustrate how the additional folding section operates to perform the additional folding on the sheet in the additional folding unit, and respectively show the additional folding section shown in FIGS. 5A to 5D as viewed from a lateral side thereof.

When the sheet S coming from the folding process mechanism 103 is transported into the additional folding unit 104 through the inlet port 119 and the transport path formed by the upper transport guide 118*a* and lower transport guide 118*b*, the additional folding rollers 114 supported by the supporting member 112 are arranged at the sheet-receiving position, i.e., home position, as illustrated in FIG. 5A and FIG. 7A. At this time, the lower ends of the additional folding rollers 114 supported by the supporting member 112 lie at the upper side of the transport path and the lower folding guide 111 lies at the lower side of the transport path so that they function as a guide for guiding the first folding line 132 of the sheet S to the nip between the additional folding rollers 114 and the lower folding guide 111. At this time, the contact 130 is positioned at an end of the first bottom horizontal part of the cam groove 131. In the embodiment illustrated herein, the second retreat position (described later) is a sheet-receiving position. The sheet-receiving position may differ from the second retreat position, provided that it is closer to the retreat position (either first retreat position or second retreat position) than to the sheet-pressing position and that the additional folding rollers 114 are spaced apart from the lower folding guide 111.

Figure 5B:
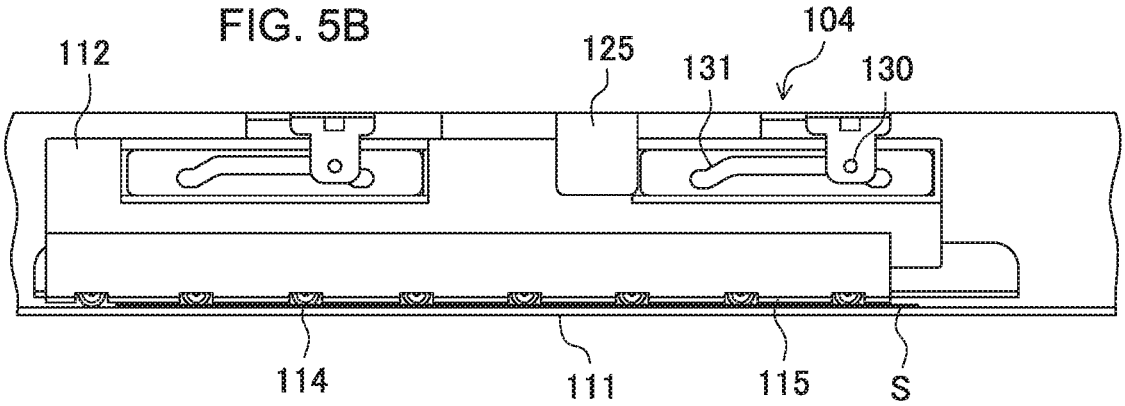
Figure 7B:
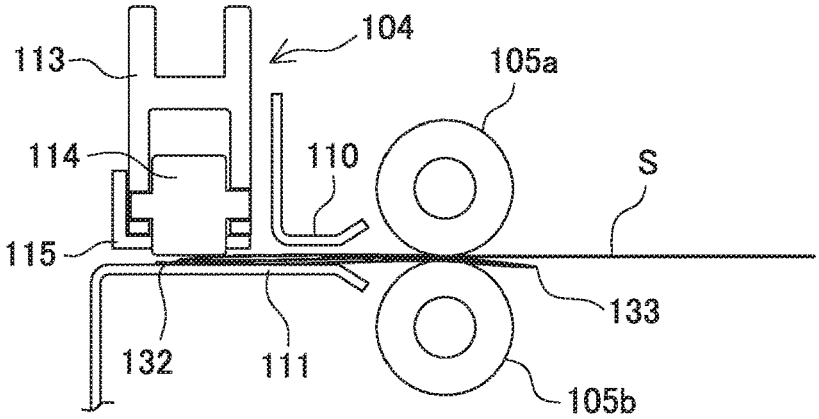

A sheet-position detecting means (not shown) arranged upstream relative to the lower folding guide 111 may detect the position of the sheet S. Then, it is determined that the first folding line 132 made at the front edge of the sheet S transported from the folding roller pair 105 into the inlet port 119 has reached a position below the additional folding rollers 114. The transport of the sheet is stopped, and the additional-folding drive motor 128 is then driven, moving the supporting member 112 in the horizontal direction, together with the slider 124, by means of the rack 127 and the pinion rotating together with the pulley 126. The contact 130 engaged with the cam groove 131 moves from the first horizontal bottom part of the cam groove 131 to the first inclining part thereof. As the contact 130 moves so, the supporting member 112 moves down toward the lower folding guide 111. Then, as shown in FIG. 5B and FIG. 7B, the additional folding rollers 114 supported by the supporting member 112 move to the pressing position, and press the sheet S, at the first folding line 132, between them and the lower folding guide 111. At this time, one edge (i.e., upstream edge as viewed in the direction the additional folding rollers 114 are moved forward) of the sheet S is nipped between the two adjacent additional folding rollers 114 arranged at one position, the additional folding rollers 114 arranged at the other end position lie on the first folding line 132 of the sheet S, and the other end of the folding line 132 (i.e., downstream end as viewed in the direction the additional folding rollers 114 move in the forward path is arranged outside the pressing-member region (see FIG. 5B). In the state of FIGS. 5A and 7B, the first folding line 132 of the sheet S has its one end arranged at the middle parts of the two adjacent additional folding rollers 114 that are at the end position. However, the phrase "between the two adjacent additional folding rollers 114 arranged at one end position" also means the position where the pressing point of the additional folding roller 114 arranged at the end position is identical to one end of the first folding line 132 of the sheet S. Further, the auxiliary members 113 holding the additional folding rollers 114 are each biased by the spring 121 toward the lower folding guide 111 and, therefore, even after the supporting member 112 moves down and then abuts on the lower folding guide 111 via the sheet S, the supporting member 112 can further be moved downward. Then, accordingly, the restriction member 115 also moves down further, pressing the first folding line 132 of the sheet S positioned below the additional folding rollers 114, and restricts the sheet thickness at the first folding line 132. The term "sheet transport direction" means the direction in which the sheet S is transported from the folding roller pair 105 into the additional folding unit 104 through the inlet port 119.

Figure 5C:
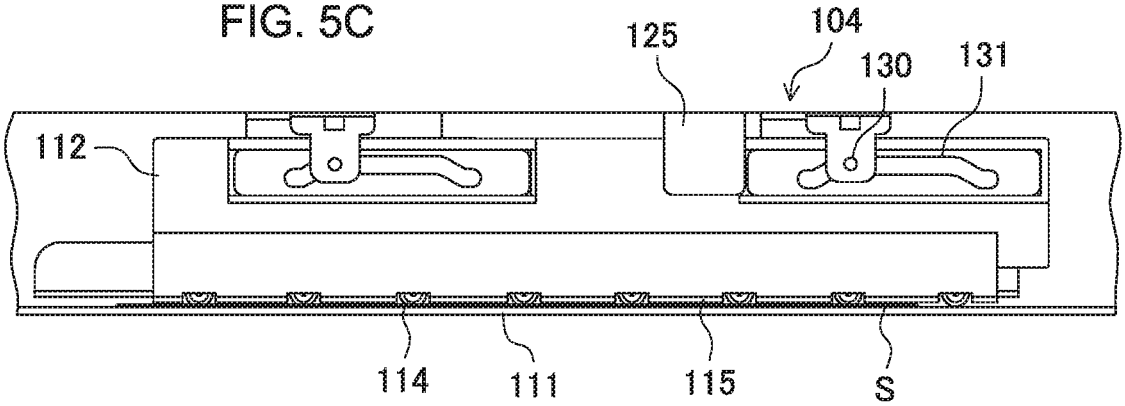
Figure 7C:
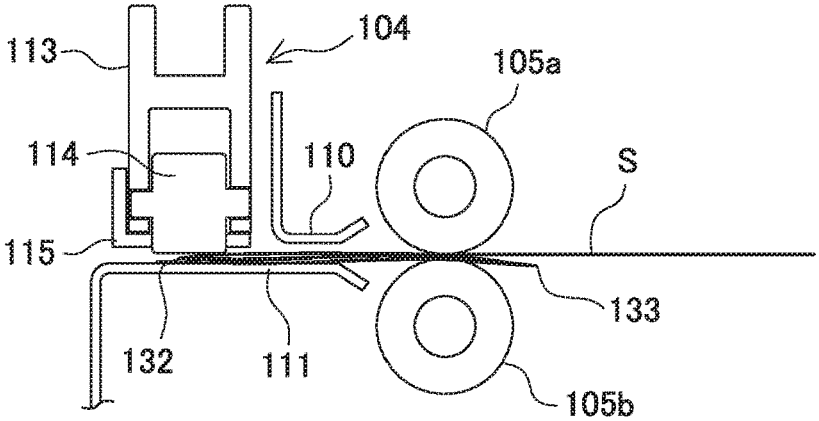

In the state illustrated in FIG. 5B and FIG. 7B, the additional-folding drive motor 128 is driven, moving the supporting member 112 further in the horizontal direction, together with the slider 124. Then, as shown in FIG. 5C and FIG. 7C, the point at which the contact 130 engages in the cam groove 131 moves from the first inclining part of the cam groove 131 to the top horizontal part thereof. The plurality of additional folding rollers 114 that are supported by the supporting member 112 are moved at the pressing position relative to the lower folding guide 111 along the first folding line 132 of the sheet S by a distance not less than the pitch at which the additional folding rollers 114 are arranged, until the leading additional folding roller 114 as viewed in the moving direction rides over the other end of the first folding line 132 of the sheets S (the downstream end in the moving direction of the additional folding rollers 114 in the forward path), while the restriction member 115 that is secured to the supporting member 112 is limiting the thickness of the first folding line 132 of the sheet S so as not to be greater than the predetermined thickness (which is equal to distance d1). More specifically, the other end of the first folding line 132 of the sheet S is arranged between the two adjacent additional folding rollers 114 provided at the other end position, the additional folding roller 114 arranged at one end position rides on the first folding line of the sheet S, and one end of the first folding line 132 of the sheet S (i.e., upstream end in the direction in which the additional folding rollers 114 are moved forward) is arranged outside the pressing-member region (see FIG. 5C). In FIG. 5C and FIG. 7C, the other end of the first folding line 132 of the sheet S is located between the two adjacent additional folding rollers 114 located at the end position. However, the phrase used above, "between the two adjacent additional folding rollers 114 arranged at the end position" also means that the pressing point of the additional folding roller 114 arranged at the end position is identical to the other end of the folding line 132 of the sheet S. Thus, the additional folding rollers 114 and the lower folding guide 111 press the sheet S at the entire first folding line 132, thereby intensifying the folding line, namely performing the additional folding.

Figure 5D:
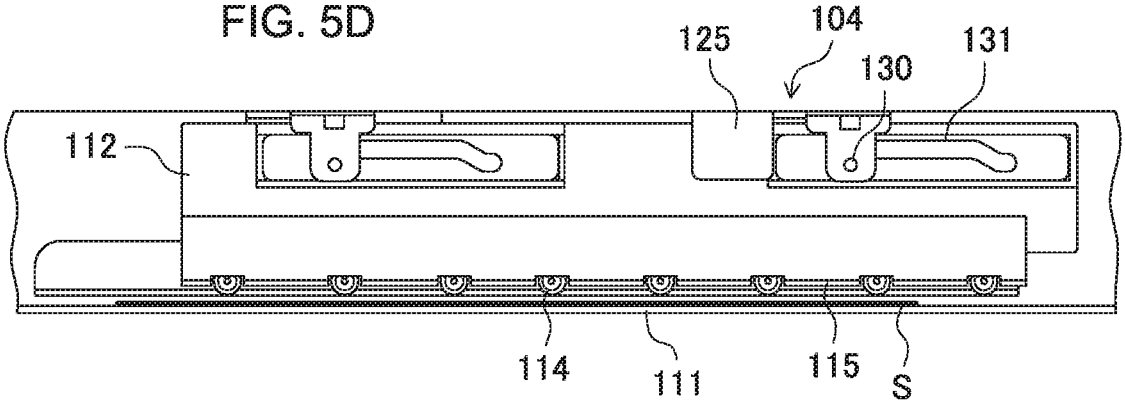
Figure 7D:
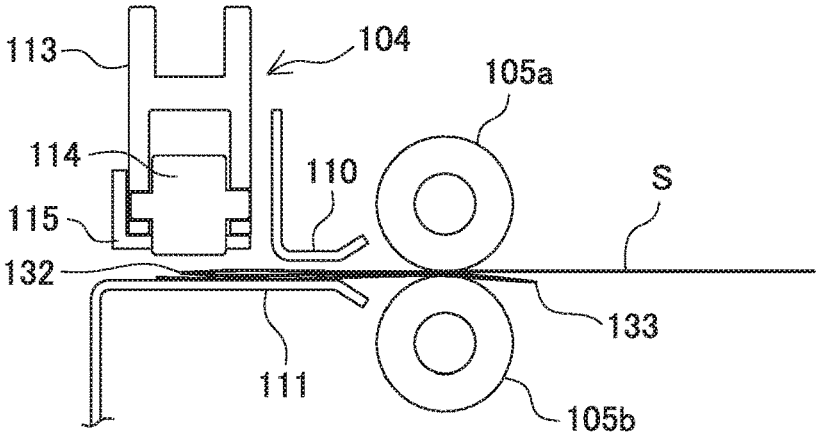

In the state shown in FIG. 5C and FIG. 7C, the additional-folding drive motor 128 is driven, further moving the slider 124 and the supporting member 112 in the horizontal direction. Then, the contact 130 moves in the cam groove 131, from the top horizontal part to the second inclining part and then to the second bottom horizontal part. As a result, as shown in FIGS. 5D and 7D, the supporting member 112 moves up from the lower folding guide 111, together with the restriction member 115, approaches the position where the additional folding rollers 114 supported by the supporting member 112 have pressed the sheet, and then moves to the first retreat position. The first additional folding is thereby completed. The first retreat position is different from the home position where the sheet is received.

When the first additional folding is completed, and the apparatus assumes the state of FIG. 5D and FIG. 7D, the transporting roller pair 102 and the folding roller pair 105, all positioned upstream in the sheet transport direction, can transport the sheet S. In the state shown in FIGS. 5A and 7D, the transporting roller pair 102 and the folding roller pair 105 transport the sheet S. The position of the sheet S is detected by the sheet-position detecting means arranged upstream relative to the folding roller pair 105, and it is determined that the second folding line 133, which is positioned closer to the rear edge of the sheet S, as viewed in the sheet transport direction, than the first folding line 132, has reached a position below the additional folding rollers 114. Then, transport of the sheet S is stopped.

Figure 6E:
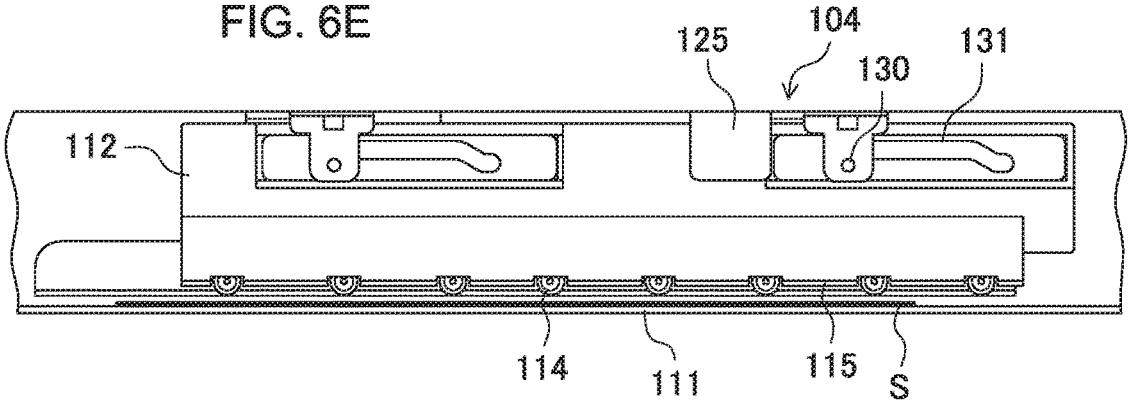
FIGS. 6E to 6H illustrate how the additional folding section operates in the additional folding unit to perform an additional folding process on the sheet.
Figure 6F:
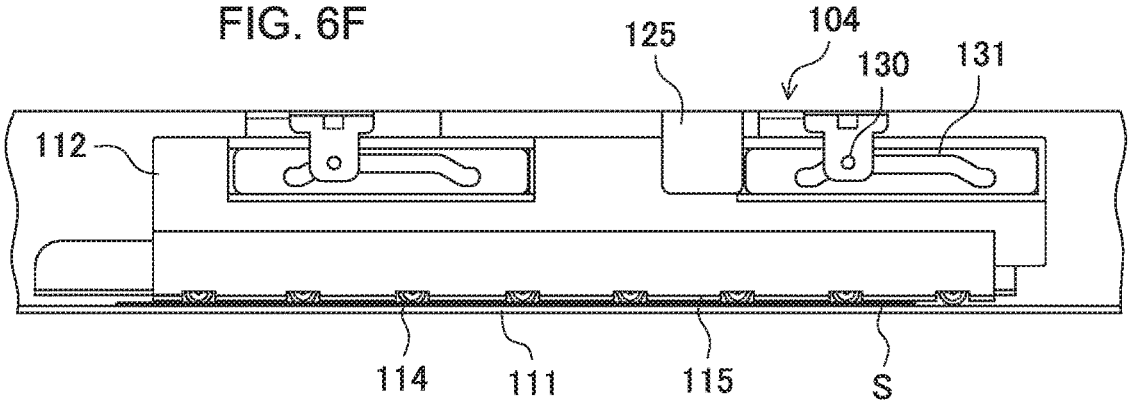
Figure 8E:
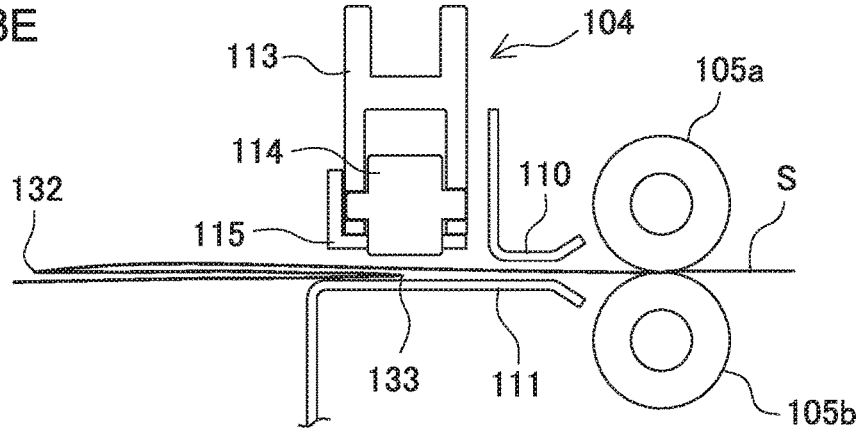
FIG. 8E to 8H illustrate how the additional folding section operates to perform the additional folding on the sheet in the additional folding unit, and respectively show the additional folding section shown in FIGS. 6E to 6H as viewed from a lateral side thereof.
Figure 8F:
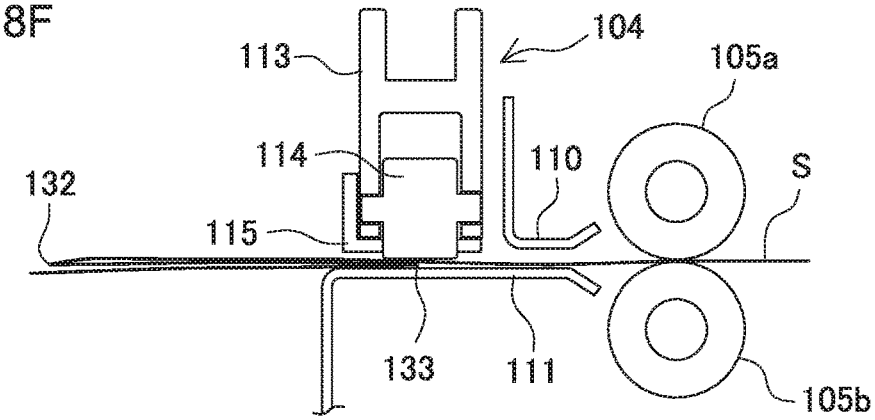

When the sheet S is stopped, with its second folding line 133 located below the additional folding rollers 114, the additional-folding drive motor 128 is driven in reverse direction relative to the forward direction. The supporting member 112 is thereby moved horizontally in the reverse direction together with the slider 124, by the rack 127 and the pinion rotating together with the pulley 126. The contact 130 engaged with the cam groove 131 therefore moves from the second bottom horizontal part of the cam groove 131 to the second inclining part thereof. As the contact 130 so moves, the supporting member 112 moves down toward the lower folding guide 111. Then, as shown in FIG. 6F and FIG. 8F, the additional folding rollers 114 supported by the supporting member 112 move to the pressing position where the sheet S is pressed, at the second folding line 133, between the lower folding guide 111 and the additional folding rollers 114. At this time, the additional folding rollers 114 are positioned at the starting point of the backward transport path, which is identical to the ending point of the forward transport path. Further, at this time, one end of the second folding line 133 of the sheet S (i.e., the upstream end as viewed in the direction in which the exists additional folding rollers 114 move in the backward transport path) is positioned between the two adjacent additional folding rollers 114 provided at one position, and the additional folding rollers 114 arranged at the other end position ride on the second folding line 133 of the sheet S. Hence, the other end of the second folding line 133 of the sheet S (i.e., the upstream end as viewed in the direction the additional folding rollers 114 are moved backward) is arranged outside the pressing-member region (see FIG. 6F). Since the auxiliary members 113, to which the additional folding rollers 114 are secured, are biased by the spring 121 toward the lower folding guide 111, the supporting member 112 moves down. The supporting member 112 can therefore move further down even after the additional folding rollers 114 abut on the lower folding guide 111 through the sheet S. As the supporting member 112 moves so, the restriction member 115 further moves down, too, pressing the sheet S at the part lying below the additional folding rollers 114 and also at the second folding line 133. The thickness of the sheet S, at the second folding line 133, is thereby restricted to a value equal or smaller than the predetermined value.

Figure 6G:
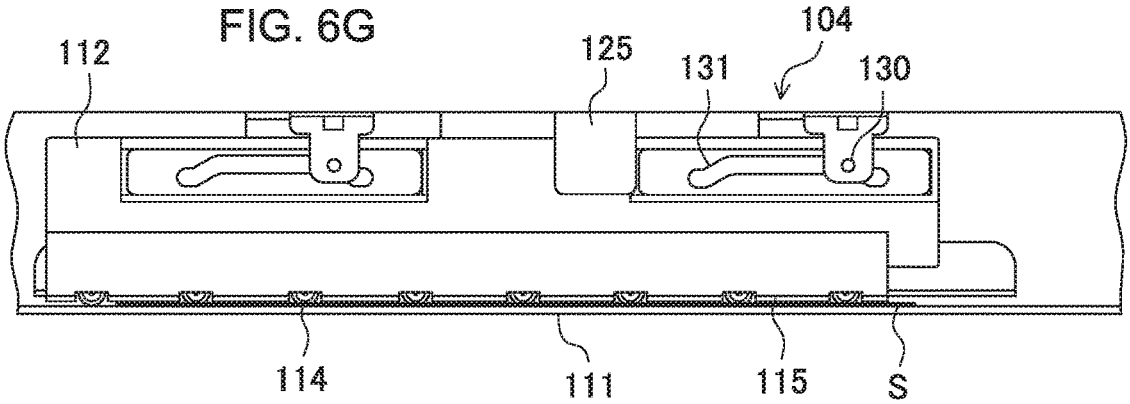
Figure 8G:
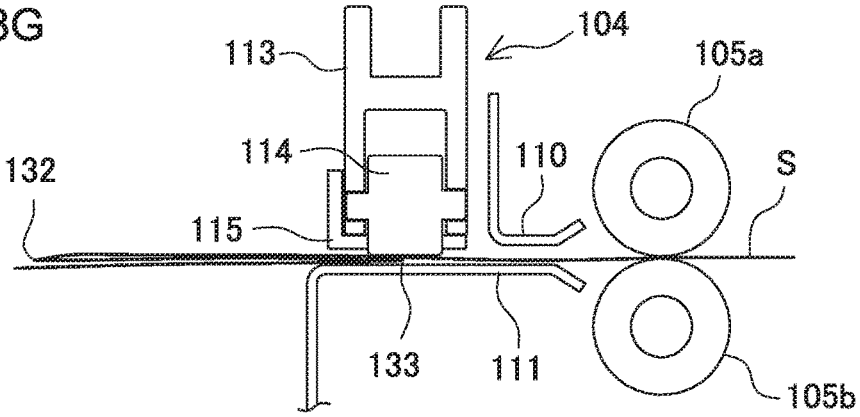

In the state illustrated in FIG. 6F and FIG. 8F, the additional-folding drive motor 128 is driven, further moving the slider 124 and the supporting member 112 backwards in the horizontal direction. The contact 130 therefore moves from the second inclining part of the cam groove 131 to the top horizontal part thereof, as shown in FIG. 6G and FIG. 8G. Then, the restriction member 115 secured to the supporting member 112 restricts the thickness of the sheet S, at the second folding line 133, to a value equal to or smaller than the predetermined value (equivalent to distance d1). While the restriction member 115 is restricting the thickness of the sheet S, the additional folding rollers 114 supported by the supporting member 112 move, at the pressing position in the reverse direction with respect to the lower folding guide 111 and along the second folding line 133 of the sheet S, for a distance equal to or greater than one pitch of the additional folding rollers 114. The additional folding rollers 114 move so until the foremost roller 114 passes over the end of the second folding line 133 of the sheet S. The second folding line 133 is thereby intensified by the pressing over the entire region by means of the additional folding rollers 114 and the lower folding guide 111. Namely, in this way, the additional folding is performed.

Figure 6H:
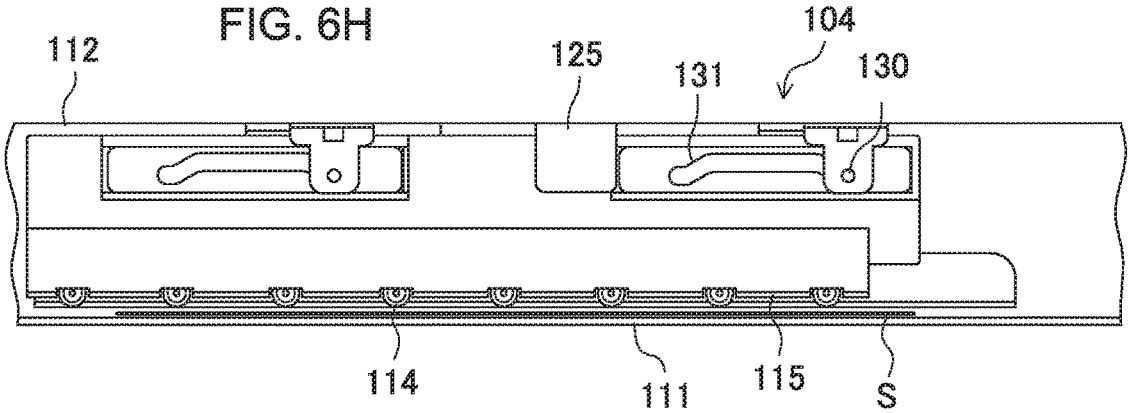
Figure 8H:
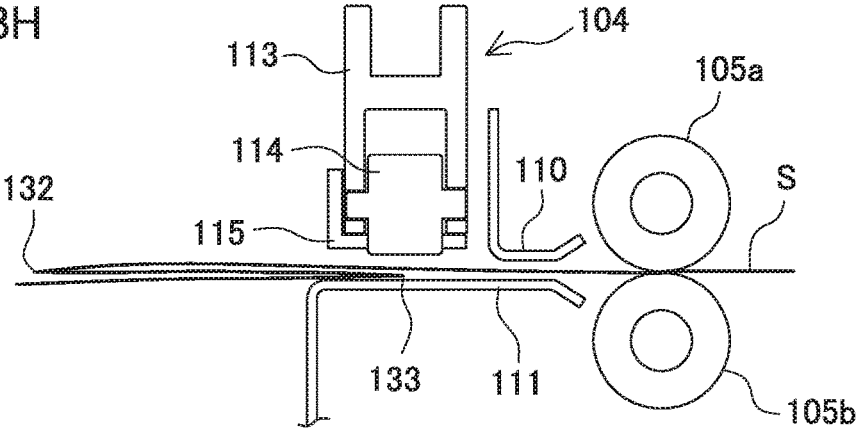

In the state illustrated in FIG. 6G and FIG. 8G, the additional-folding drive motor 128 is driven, moving the slider 124 and the supporting member 112 backwards in the horizontal direction still further. The contact 130 engaged with the cam groove 131 further moves from the top horizontal part of the cam groove 131 to the first inclining part, and then to the first horizontal part. Therefore, as shown in FIG. 6H and FIG. 8H, the supporting member 112 moves up from the lower folding guide 111, together with the restriction member 115. The supporting member 112 reaches the second retreat position adjacent to the position to which the additional folding rollers 114 supported by the supporting member 112 reach after they finish pressing the sheet S. At this time, the second additional-folding process is terminated. In this embodiment, the second retreat position is set at the sheet-receiving position that is the home position. Nonetheless, the second retreat position may be set at a different point.

After the series of additional folding operation is completed, the transporting roller pair 102 and the folding roller pair 105 arranged upstream in the sheet transport direction transport the sheet S toward the post-process apparatus C that is arranged downstream in the sheet transport direction. The lower-end parts of the additional folding rollers 114 moved to the retreat position and the bottom of the restriction member 115 function also as guides at the time of ejecting the sheet S which has been additionally folded.

When the pressing-member region is made to cover the entire folding line of the sheet S, there arises a need for securing a space that is enough to accommodate at least the part of the pressing-member region that is disposed outside the folding line of the sheet S on the upstream side as viewed in the moving direction of the additional folding rollers 114 that is running along the folding line and on the side of the folding line of the sheet and, at the same time, also for securing a space on the downstream side as viewed in the moving direction and on a lateral side of the folding line of the sheet that is at least enough to allow the movement along the folding line of the sheet S of the supporting member 112 for pressing the folding line in addition to the part of the pressing-member region disposed outside the folding line of the sheet. However, in the additional folding unit 104 of the sheet folding process apparatus B shown in the drawings, the initial position of the leading additional folding roller 114 that is moving toward the folding line as viewed in the moving direction of the additional folding rollers 114 is located on the folding line of the sheets and hence the pressing-member region is not located outside the folding line of the sheet S as viewed in the moving direction. Therefore, the additional folding unit 104 can be downsized to the extent of non-existence of the pressing-member region disposed outside the folding line of the sheet S at the initial position of the additional folding rollers 114 for moving along the folding line.

In the additional folding unit 104, when the first drive mechanism 116 moves the additional folding rollers 114 relative to the lower folding guide 111 from the retreat position or sheet-receiving position to the pressing point, one end of the folding line of the sheet S (i.e., upstream end as viewed in the motion along the folding line) is arranged between two additional folding rollers 114 located at one position in the pressing-member region. At the same time, the other end of the folding line of the sheet S (i.e., downstream end as viewed in the motion along the folding line) is arranged outside the pressing-member region (namely, outside the additional folding rollers 114 positioned at the other end position in the pressing-member region (namely, outside the additional folding rollers 114 positioned at the other end position in the pressing-member region). If the additional folding rollers 114 are spaced at regular intervals in the direction the additional folding rollers 114 are moved along the folding line, they 114 must be moved along the folding line for a distance longer than the distance between the adjacent additional folding rollers 114 (namely, one-pitch distance) in order to press the sheet S all along the folding line between the adjacent additional folding rollers 114, on one hand, and the lower folding guide 111, on the other hand. Therefore, the additional folding rollers 114 at the end position on the upstream side as viewed in the moving direction that is running along the folding line ride over the end of the sheet S on the upstream side as viewed in the moving direction to reliably get to the position of the additional folding roller 114 disposed at the end position on the upstream side as viewed in the moving direction in the initial stage of the movement so that the end part of the sheet S located between the two additional folding rollers 114 at the end position on the upstream side as viewed in the moving direction in the initial stage of the movement is pressed for additional folding by moving only the smallest number of additional folding rollers 114 required to execute the additional folding process and hence the support member 112 by a distance not less than one pitch of the additional folding rollers 114.

In the additional folding unit 104, the pressing-member region should preferably be shorter than the folding line of the sheet by one pitch of the adjacent additional folding rollers 114. When the second drive mechanism 117 moves the additional folding rollers 114 relative to the lower folding guide 111 from the retreat position or the sheet-receiving position to the pressing position, the ends of the folding line of the sheet lie between the two additional folding rollers 114 adjacent to each other in the pressing-member region. Therefore, if the additional folding rollers 114 at the upstream end positions along the folding line of the sheet S in the moving direction are arranged near the ends of the folding line, they move along the folding line for a distance which is slightly longer than one pitch of the adjacent additional folding rollers 114. The additional folding rollers 114 at the end position downstream in the moving direction along the folding line therefore pass that part of the sheet which is located outside the pressing-member region at the beginning of transporting the sheet, and then move over the edge of the sheet S, which is downstream in the sheet transport direction. Therefore, the sheet S can be pressed at its rear edge positioned at the downward side of the pressing-member region in the moving direction at the start of transporting the sheet S, and the additional folding of the sheet S can be thereby achieved. That is, the additional folding can be performed along the entire folding line of the sheet S, by moving the smallest number of additional folding rollers 114 required to execute the additional folding process only by a distance slightly longer than one pitch of the rollers 114. This suppresses an increase in the time required for the additional folding process. Further, the pressing-member region space and the space provided on the side of the folding line of the sheet S and allowing the supporting member 112 to move can be much reduced. Hence, the additional folding unit 104 can be made even smaller.

In addition, the additional folding unit 104 folds the sheet S by moving the additional folding rollers 114 in the forward direction, thereby making a folding line. In order to make another folding line as in the instance of Z-fold or inner trifold, the sheet S is additionally folded by moving the additional folding rollers 114 in the backward direction. Thus, the sheet S is pressed at different folding lines as the additional folding rollers 114 are moved back and forth. Therefore, the additional folding can be performed, making two or more folding lines, at high efficiently and within a short time.

It has been described how the additional folding unit 104 performs the additional folding, thereby folding a sheet in the shape of letter Z. The additional folding unit 104 can also fold a sheet three times or more, making three or more folding lines on the sheet. If sheets are folded once as in double folding and therefore have only one folding line, a preceding sheet is additionally folded while it is transported forward and then ejected, and the following sheet is folded while it is transported backward. The sheets, one following another, can therefore be additionally folded at high efficiently and in a short time. If a sheet has four-fold, which is a sheet that is folded three times, or more than four-fold, the sheet is stopped every time one folding line reaches a position below the additional folding rollers 114, and the additional folding rollers 114 are then moved forward or backward along the folding line, thereby additionally folding the sheet. In addition, not only a single sheet, but also sheets bound together or sheets not bound together may be folded.

A sheet pressing apparatus according to this invention and an image forming system having the sheet pressing apparatus have been described with reference to the embodiments illustrated herein. This invention is not limited to the sheet pressing apparatus and the image forming system, nevertheless. For example, in the embodiment illustrated, the first drive mechanism 116 is composed of the guide rail 123, slider 124, bracket 125, pulley 126, rack 127, additional-folding drive motor 128, belt 129, contact 130, and the first and second inclining parts of the cam groove 131, and the second drive mechanism 117 is composed of the guide rail 123, slider 124, bracket 125, pulley 126, rack 127, additional-folding drive motor 128, belt 129, contact 130, and the top horizontal part of the cam groove 131. However, if the supporting member 112 can be moved close to and away from the lower folding guide 111 and along the folding line of the sheet S, neither the first drive mechanism 116 nor the second drive mechanism 117 is limited to those illustrated. The first and second mechanisms 116 and 117 may be, for example, direct drive mechanisms. Further, in the embodiment illustrated, the additional folding rollers 114 are moved with respect to the lower folding guide 111. Instead, the lower folding guide 111 may be moved with respect to the additional folding rollers 114. Both the additional folding rollers 114 and the lower folding guide 111 may be moved. To move the lower folding guide 111 so, it suffices to provide a lift mechanism for the lower folding guide 111. Further, a spring may be used to bias the lower folding guide 111 toward the additional folding rollers 114.

What is claimed is:

1. A sheet pressing apparatus designed to perform an additional folding on a sheet already folded and having a folding line, and comprising:

an inlet port configured to receive a sheet having a folding line made in a folding process and transported in a prescribed transport direction;

a supporting member arranged downstream from the inlet port in the prescribed transport direction and able to move in a prescribed direction;

a plurality of first pressing members arranged and supported along the folding line of the sheet, in a prescribed arrangement region of the supporting member;

a second pressing member arranged, opposing the first pressing members, and configured to cooperate with the first pressing members to press the sheet at the folding line;

a first drive mechanism configured to move the first pressing members with respect to the second pressing member between a pressing position where the folding line is pressed between the first pressing members and the second pressing member and a retreat position where the first pressing members are spaced apart from the second pressing member, moving away from the pressing position, when the supporting member is moved with respect to the second pressing member;

a second drive mechanism configured to move the first pressing members at the pressing position, with respect to the second pressing member, and then to move the supporting member with respect to the second pressing member, thereby moving the first pressing members with respect to the second pressing member along the folding line, a contact, and a guide groove that is engaged with the contact and guides the supporting member along the folding line at the pressing position, the guide groove having a region that extends in a direction of the folding line for a distance longer than a distance between any two adjacent first pressing members, wherein said arrangement region has such a length that when the first drive mechanism causes the first pressing members to move relative to the second pressing member from the retreat position to the pressing position, one end of the folding line is arranged between the two adjacent first pressing members located at one position and the first pressing member at the other end position is arranged on the folding line.

2. The sheet pressing apparatus according to claim 1, wherein the arrangement region is shorter than the folding line of the sheet.

3. The sheet pressing apparatus according to claim 2, wherein the first pressing members are arranged so as to be equally spaced apart in the arrangement region, and the arrangement region is shorter than the folding line of the sheet by the distance between the adjacent first pressing members.

4. The sheet pressing apparatus according to claim 1, further comprising a bias member provided between the supporting member and the first pressing members and biasing the first pressing members toward the folding line.

5. An image forming system comprising:

an image forming apparatus configured to form an image on a sheet and transport the image-formed sheet;

a sheet processing apparatus configured to perform a folding process on the sheet delivered from the image forming apparatus; and the sheet pressing apparatus according to claim 1.

6. A sheet pressing apparatus designed to perform an additional folding on a sheet already folded and having a folding line, and comprising:

an inlet port configured to receive a sheet having a folding line made in a folding process and transported in a prescribed transport direction;

a supporting member arranged downstream from the inlet port in the prescribed transport direction and able to move in a prescribed direction;

a plurality of first pressing members arranged and supported along the folding line of the sheet, in a prescribed arrangement region of the supporting member;

a second pressing member arranged, opposing the first pressing members, and configured to cooperate with the first pressing members to press the sheet at the folding line;

a first drive mechanism configured to move the first pressing members with respect to the second pressing member between a pressing position where the folding line is pressed between the first pressing members and the second pressing member and a retreat position where the first pressing members are spaced apart from the second pressing member, moving away from the pressing position, when the supporting member is moved with respect to the second pressing member;

a second drive mechanism configured to move the first pressing members at the pressing position, with respect to the second pressing member, and then to move the supporting member with respect to the second pressing member, thereby moving the first pressing members with respect to the second pressing member along the folding line, and a control section configured to control an operation of the sheet pressing apparatus, wherein said arrangement region has such a length that when the first drive mechanism causes the first pressing members to move relative to the second pressing member from the retreat position to the pressing position, one end of the folding line is arranged between two adjacent first pressing members located at one position and the first pressing member at the other end position is arranged on the folding line, the sheet has first and second folding lines, the retreat position includes first and second retreat positions different from each other, and the control section first causes the second drive mechanism to move the first pressing members forward with respect to the second pressing member along the first folding line at the pressing position, then causes the first drive mechanism to move the first pressing members to the first retreat position with respect to the second pressing member, to move the sheet in the transport direction and to stop the second folding line between the first pressing members and the second pressing member, further causes the first drive mechanism to move the first pressing members to the pressing position with respect to the second pressing member and causes the second drive mechanism to move the first pressing members backward along the second folding line with respect to the second pressing member at the pressing position, and finally causes the first drive mechanism to move the first pressing members to the second retreat position with respect to the second pressing member.

* * * * *